United States Patent [19]

Eisberg

[11] Patent Number: 5,029,454

[45] Date of Patent: Jul. 9, 1991

[54] DUAL FLOW VARIABLE AREA EXPANSION DEVICE FOR HEAT PUMP SYSTEM

[75] Inventor: Keith V. Eisberg, Martinsville, Ind.

[73] Assignee: Carrier Corporation, Syracuse, N.Y.

[21] Appl. No.: 558,287

[22] Filed: Jul. 26, 1990

[51] Int. Cl.[5] ..... F25B 13/00

[52] U.S. Cl. ..... 62/324.6; 62/324.1; 62/222; 62/528; 137/493.8

[58] Field of Search ..... 62/324.1, 324.6, 528, 62/222; 137/493.8, 513.3.

[56] References Cited

U.S. PATENT DOCUMENTS 3,404,542 10/1968 Fineblum ..... 62/324.6

4,341,090 9/1982 Ramakrishnan ..... 62/324.6

*Primary Examiner*—Henry A. Bennett

*Assistant Examiner*—John Sollecito

*Attorney, Agent, or Firm*—Frederick A. Goettel, Jr.

[57] ABSTRACT

A flow metering device for use as an expansion valve in a heat pump system includes a body having a flow passage extending therethrough. A piston having a flow metering port extending therethrough is moveably positioned within the flow passage. An elongated member extends through the metering port of the piston and is axially and radially fixed within the body. The elongated member has a central portion which cooperates with the metering port to prevent flow through the port when axially aligned with it. The elongated member has flow metering configurations formed thereon on both sides of the central portion. The piston is spring biased into alignment with the central portion. Refrigerant flow in either direction through the device results in movement of the piston against a spring force into a flow metering relationship with one of the metering configurations. The size of the flow metering passages defined by the flow metering port and the metering configurations are a function of the position of the piston, which is, in turn, a function of the pressure differential across the device.

9 Claims, 2 Drawing Sheets

DUAL FLOW VARIABLE AREA EXPANSION DEVICE FOR HEAT PUMP SYSTEM

BACKGROUND OF THE INVENTION

1. Field of the Invention

This invention relates in general to refrigerant expansion devices for use in thermodynamically reversible compression refrigeration systems having heating and cooling modes of operation. More specifically, this invention relates to a single mechanical expansion device that is capable of operating as a variable area expansion device for both the heating and cooling modes of such a system.

2. Description of the Prior Art

A compression refrigeration system comprises a compressor, a condenser, an expansion device and an evaporator connected in a closed circuit to provide refrigeration. Hot compressed refrigerant vapor from the compressor enters the condenser, where it transfers heat to an external heat exchange medium and condenses. Liquid refrigerant, at a high pressure, flows through the expansion device, where the refrigerant undergoes a pressure drop and at least partially flashes to a vapor. The liquid vapor mixture then flows through the evaporator where it evaporates and absorbs heat from the external surroundings. The low pressure refrigerant vapor then returns to the compressor to complete the circuit. It has long been recognized that the energy rejected from a refrigeration cycle during condensation may be used to provide heating. Such a system where the flow of refrigerant through the heat exchangers is reversed is commonly referred to as a heat pump.

Typically, to convert the cooling cycle to a heating cycle the duty of the two heat exchangers is thermodynamically reversed. To achieve this result, the direction of refrigerant flow through the system is reversed by changing the connection between the suction and the discharge side of the compressor and the two heat exchangers. This is accomplished for example, by repositioning a four-way valve which interconnects the heat exchangers with the inlet and outlet to the compressor. The cooling condenser then functions as an evaporator, while the cooling evaporator serves as a heating condenser. To complete the thermodynamic reversal, the refrigerant must be throttled in the opposite direction between the heat exchangers. Reversible refrigerant cycles have typically used a capillary tube or a double expansion valve and by-pass system positioned in the supply line connecting the two heat exchangers to accomplish throttling in either direction.

Capillary tubes impose serious limitations upon the operational range of a heat pump system in which they are used and accordingly are not frequently employed.

In the double expansion valve arrangement, two opposed expansion valves are positioned in the refrigerant supply line extending between the two heat exchangers. A valve operated by-pass is also positioned parallel to each expansion valve. When the refrigeration cycle is reversed, the by-pass valves are actuated to alternatively utilize one expansion device and by-pass the other.

Commonly assigned U.S. Pat. No. 3,992,898 entitled "Movable Expansion Valve" and issued on Nov. 23, 1976, in the name of Duell, et. al. discloses an expansion device wherein the refrigerant metering port is formed in a free floating piston which is mounted within a chamber. When refrigerant flows through this device in one direction, the free floating piston moves to one position wherein the refrigerant flow is through the metering port thereby serving as an expansion device. When refrigerant flows through this device in the opposite direction, the free floating piston moves to a second position wherein refrigerant is allowed to flow through a number of flow channels formed in the outer peripheral surface of the piston to thereby allow substantially unrestricted flow through the device. This arrangement allows such a device to be used, in combination with a second expansion device of the same design, in a heat pump system to allow the desired expansion of the refrigerant through the system flowing in both the cooling and heating directions. One device is located adjacent to the indoor coil for the cooling mode of operation while the second device is located near the outdoor coil for the heating mode of operation.

In each of the above-described heat pump systems, the system includes two expansion devices, one being dedicated to the cooling mode of operation and the other to the heating mode of operation. Further, each of the expansion devices is of the fixed orifice type wherein a single fixed orifice is selected for each mode of operation which represents a compromise orifice for the wide range of operating conditions which the system may see in each of the modes of operation.

One way of obtaining variable control of the expansion orifice is the use of thermostatic expansion valves. A thermostatic expansion valve controls the flow rate of liquid refrigerant entering the coil serving as an evaporator as a function of the temperature and pressure of the refrigerant gas leaving the evaporator. While being highly efficient in their operation and readily responsive to changes in load upon the system to vary the flow of refrigerant to the evaporator, thermostatic expansion valves are also complicated and expensive.

It has been recognized that the need exists for a refrigerant expansion device which is inexpensive to manufacture and which is effective in performance over a wide range of operating conditions. One approach to solving this problem has been to design a refrigerant flow metering device which has a flow metering passage which varies in cross-section in response to changes between the high and low side pressures in the refrigeration system. One such device is described in commonly assigned U.S. Pat. No. 3,659,433 entitled "Refrigeration System Including a Flow Metering Device" issued on May 2, 1972 in the name of David N. Shaw.

One device which provides such a response is a flow metering valve which has a housing with a flow passage in which is mounted a movable piston having a flow metering port extending therethrough. An elongated member within the housing extends into the metering port of the piston. The elongated member and the metering port cooperate to define a flow metering passage between them. The elongated member is configured such that the cross-sectional area varies in relation to the position of the elongated member to the flow metering port. Means are provided for supporting the elongated member within the housing and for controlling the axial position of the elongated member and the piston with respect to one another as a function of the differential pressure across the flow metering piston.

As discussed above in connection with the '898 patent, it is common practice to use two expansion devices in a heat pump system, one dedicated to the cooling mode of operation and the other dedicated to the heating mode.

It has long been an objective to provide a single expansion valve which is capable of providing the expansion function in both the cooling and heating modes of operation of a heat pump system.

One approach has been a dual flow electronic expansion valve. One such valve is disclosed in U.S. Pat. No. 4,548,047 entitled "Expansion Valve" issued on Oct. 22, 1985 to Hayashi, et al. This patent describes an expansion valve which has the ability to allow reversible flow of the refrigerant to take place. The system disclosed therein allows control of the flow rate of the refrigerant regardless of the direction of flow of the refrigerant, so that control may be effected both in the cooling and heating modes by using a single valve. In this patent, electric input signals are generated by a complex electronic control system which are in turn applied to an electromagnetic coil which controls a plunger which in turn actuates the valve.

Another electronically controlled expansion valve is shown in U.S. Pat. No. 4,686,835 entitled "Pulse Controlled Solenoid Valve With Low Ambient Start-up Means", issued on Aug. 18, 1987 to Alsenz. Electronically actuated solenoid flow control valves of the type disclosed in these patents require programmed multiprocessor control systems which are extremely expensive. As a result, such control devices are economically attractive in only the most expensive air conditioning-/heat pump systems.

The need accordingly exists for a simple, inexpensive, single expansion device that is capable of efficiently controlling a heat pump system in both the heating and cooling modes of operation.

SUMMARY OF THE INVENTION

An object of the present invention is a mechanical refrigerant expansion device which is capable of metering the flow of refrigerant therethrough in either direction.

It is another object of the present invention to meter the flow of refrigerant in a refrigerant expansion device in one direction therethrough through a first orifice which varies in size as a function of the pressure differential between the high and low pressure sides of a refrigeration system, and through a second orifice which also varies in size as a function of system pressure differential in the other direction therethrough.

It is a further object of the invention to provide a mechanical refrigerant expansion device which is capable of metering the flow of refrigerant for the cooling mode of operation in one direction therethrough and for the heating mode of operation in the other direction.

It is yet another object of the invention to provide a mechanical refrigerant expansion device which prevents refrigerant flow through the device during the off cycle.

It is a related object of the present invention to achieve these and other objects with a simple, safe, low cost, reliable expansion device.

These and other objects of the present invention are achieved by a fluid flow metering device which includes a body having a flow passage extending therethrough. A piston having a flow metering port extending therethrough is moveably disposed within the flow passage. An elongated flow metering member extends through the flow metering port. The elongated member includes a centrally position sealing configuration which is adapted to cooperate with the flow metering port of the piston to prevent fluid flow through the port when the piston and the sealing configuration are aligned with one another. The elongated member includes a first flow metering configuration on one side of the sealing configuration which is adapted to cooperate with the flow metering port to define a first flow metering passage when they are axially aligned with one another. The cross sectional area of the first flow metering passage varies in relationship to the axial position of the piston with respect to the first flow metering configuration. The elongated member includes a second flow metering configuration on the other side of the sealing configuration which is adapted to cooperate with the flow metering port of the piston to define a second flow metering passage when they are axially aligned with one another. As with the first flow metering passage, the cross sectional area of the second flow metering passage varies in relationship to the axial position of the piston with respect to the second flow metering configuration. Means are provided for axially and radially supporting the elongated member within the body. Means are also provided for supporting the piston within the flow metering passage in axial alignment with the sealing configuration when no fluid is flowing through the device. The support means also serves to control the axial position of the piston with respect to the first flow metering configuration as a function of the pressure differential across the piston when fluid is flowing through the device in one direction. The support means also controls the axial postion of the piston with respect to the second flow metering configuration as a function of pressure differential across the piston when fluid is flowing through the device in the opposite direction.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein:

DESCRIPTION OF THE PREFERRED EMBODIMENT

Figure 1:
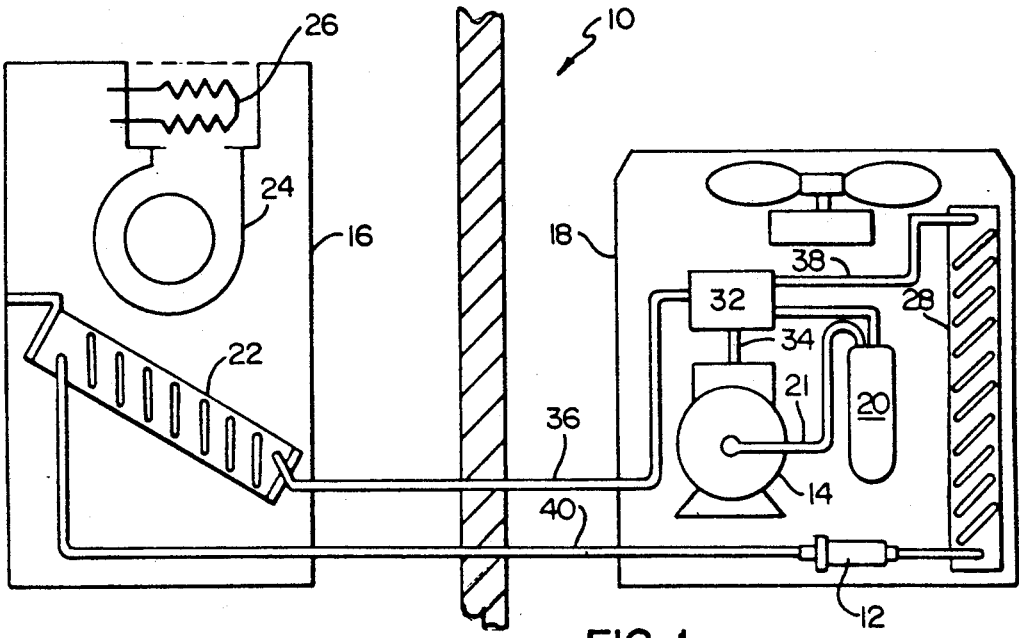
FIG. 1 is a schematic diagram of a heat pump system making use of an expansion device according to the present invention.

With reference first to FIG. 1, numeral 10 designates a heat pump of substantially conventional design, but having a mechanical dual flow variable area expansion valve 12 according to the present invention. The variable area dual flow expansion valve replaces the multiple expansion devices and check valves and/or the electronically controlled dual flow expansion valves found in the refrigerant line between the heat exchangers of many prior art heat pumps. The operation of the dual flow variable area expansion valve will be described more fully hereinafter. The heat pump 10 also includes a compressor 14, an indoor heat exchanger assembly 16 and an outdoor heat exchanger assembly 18. An accumulator 20 is shown in the compressor suction line 21; however, it is contemplated that, because of the variable metering capability of the valve, the accumulator may not be needed in a system employing the present invention.

The indoor heat exchanger assembly 16 includes a refrigerant-to-air heat exchange coil 22 and an indoor fan 24. The indoor assembly is also shown with a backup electrical resistance heating coil 26. The outdoor heat exchanger assembly 18 includes a refrigerant-to-air heat exchange coil 28 and an outdoor fan 30. The indoor and outdoor heat exchanger assemblies are of conventional design and will not be described further herein.

A four-way reversing valve 32 is connected to the compressor discharge port by a refrigerant line 34, to the compressor suction port by suction line 21 and to coils 22 and 28 by refrigerant lines 36 and 38, respectively. The reversing valve 32 is also of conventional design for directing high pressure refrigerant vapor from the compressor to either the indoor coil 22, in the heating mode of operation or, during the cooling mode and defrost, to the outdoor coil 28. Regardless of the mode of operation, the reversing valve serves to return refrigerant from the coil which is operating as an evaporator to the compressor.

A refrigerant line 40 interconnects the indoor heat exchanger coil 22 and the outdoor heat exchanger coil 28. In the embodiment shown the dual flow variable area expansion valve 12 according to the present invention, is located in the line 40 within the outdoor heat exchanger assembly housing 18, adjacent to the outdoor coil 28. The valve may also be located in the indoor assembly 16. The structure of the dual flow variable area expansion valve 12 will now be described in detail followed by a description of the operation of the valve in the cooling and heating modes of operation and a description of the operational advantages of a system which is equipped with the dual flow variable area expansion valve.

Turning now to FIGS. 2–11, it will be seen that the dual flow variable area expansion valve 12 includes a generally cylindrically body 42 which defines a cylindrical elongated chamber 44 in the interior thereof. Extending from the left hand end of the body 42 is a threaded nipple 46 having a fluid passage way 48 formed therein which communicates the interior chamber 44 with the exterior thereof. The right hand end of the body 42 is open ended and has male threads 50 formed on the exterior thereof. The open end of the body 42 is closed by an end cap 52 which has interior threads 54 which mate with the threads 50 on the body. A nipple 56, having a fluid passageway 57 therethrough, extends outwardly from the end cap 52. The fluid passageways 48 and 57 of the nipples 46 and 56, together with the interior chamber 44, define a flow passage through the expansion device. A circular washer 60 is mounted within the end cap 52 and cooperates with the end of the body 42 to established a fluid tight seal therebetween.

A first four legged cruciform like element hereinafter referred to as a first refrigerant metering spring retainer 62, is supported at the right end of the body 42 by cooperation between the end cap 52 and an interior groove 64 formed in the interior surface of the open right hand end of the body 42. The metering spring retainer 62, best shown in FIG. 8, includes a central hub like portion 66 through which a threaded opening 68 extends, and, four radially extending legs 69.

Mounted to the metering spring retainer 62, in a cantilever fashion, is a refrigerant metering rod 70. The refrigerant metering rod includes a first reduced diameter threaded portion 72 which is adapted to be threadably received within the threaded opening 68 in the metering spring retainer 62. Extending to the left from the right hand threaded portion 72 of the refrigerant metering rod 70 the rod includes a first flow metering configuration 74 which will be referred to as the heating configuration and which extends from a point of minimum cross section adjacent the threaded portion 72 to a maximum cross sectional area 76. From the point of maximum cross section 76 the rod defines a uniform diameter central portion 78 extending through the mid point of the rod. The central portion 78 has an annular groove 80 formed therein at the midpoint thereof. The groove 80 is adapted to receive an 0-ring seal 82 therein.

From the left hand end 84 of the central portion 78 of the rod a transition is made to a region 86 which defines a minimum cross sectional area of a second flow metering configuration 88 which will be referred to as the cooling configuration. The cooling configuration 88 extends to the left from the point of minimum cross section and increases in cross sectional area to a maximum point 90 adjacent the left hand end of the rod 70 where the rod terminates in a second reduced diameter threaded portion 92.

Figure 2:
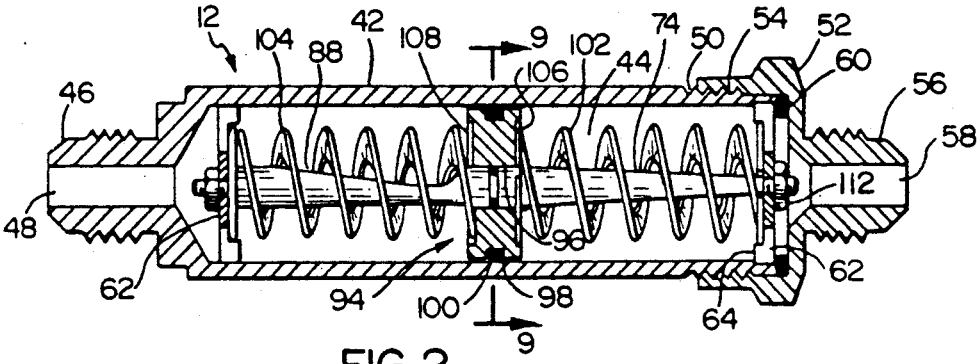
FIG. 2 is a longitudinal sectional view through an expansion device according to the present invention.
Figure 7:
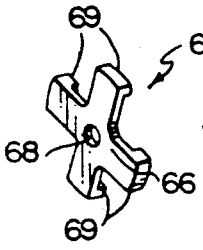
FIG. 7 is a perspective showing of the refrigerant metering assembly retaining spacer.
Figure 6:
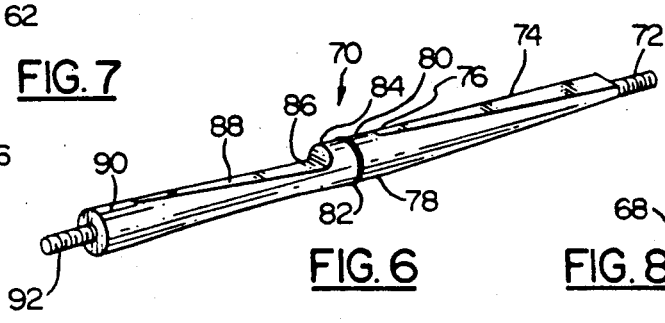
FIG. 6 is a perspective showing of the refrigerant metering rod of the expansion device of FIG. 2.
Figure 8:
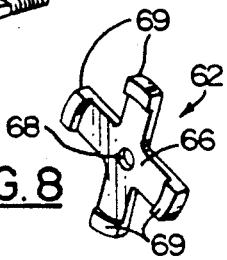
FIG. 8 is a perspective showing of the other side of the refrigerant metering spacer of FIG. 7.

A flow metering piston 94 is generally cylindrical in shape and has a refrigerant metering port 96 extending axially, centrally therethrough. The metering port 96 is of such a size that the central portion 78 of the rod with the 0-ring 82 mounted thereupon is received therein to allow a refrigerant tight seal to be established between the port 96 and the rod when the piston is mounted on the rod in the central position as shown in FIG. 2.

Figure 5:
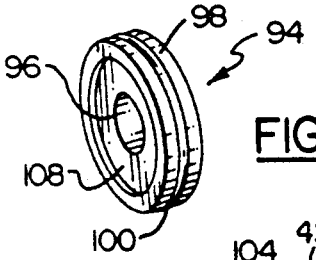
FIG. 5 is a perspective view of the refrigerant metering piston of the expansion device of FIG. 2.

The outside diameter of the piston 94, best shown in FIG. 5, is of such a dimension that the piston is received within the cylindrical chamber 44 with a clearance allowing free axial motion of the piston with respect to the body. An annular groove 98 is machined into the outside surface of the piston and a suitably sized 0-ring 100 is adapted to be received therein in a manner such that it cooperates with the groove 98 and the inside surface of the chamber to preclude refrigerant flow between these surfaces regardless of the position of the piston within the chamber 44.

A pair of refrigerant metering springs 102 and 104 each comprising a helically wound spring, are positioned within the expansion valve body 42 in coaxial relationship with the refrigerant metering rod 70, and, on opposite sides of the refrigerant metering piston 94.

The first refrigerant metering spring 102 surrounds the heating configuration 74 of the refrigerant metering rod and extends between the metering spring retainer 62 at its right hand end and a recess 106 in the right hand facing end surface of the metering piston 94. The four radially extending legs 69 of the spring retainer 62 are configured to fixedly receive and support the right hand end of the spring 102. In the embodiment shown the ends of the legs 69 are configured to threadably receive the first coil of the spring 102. The ends of the legs are then deformed, as by crimping, (not shown) into fixed engagement with the spring.

A second metering spring 104 surrounds the cooling configuration 88 of the metering rod 70 and extends between a left hand facing recess 108 on the left hand end surface of the metering piston and a second spring retainer 62. The second spring retainer threadably engages the left hand threaded end 92 of the metering rod and fixedly receives and supports the left hand end of the spring 104 in the same manner that the first spring retainer supports the spring 102, as described above.

In the static no-flow condition, as shown in FIG. 2, both springs 102 and 104 are unloaded and the piston 94 is in the central position where the metering port 96 is in sealing engagement with the 0-ring 82 carried by the rod. As thus assembled the metering spring retainers 62 are locked into position by hexagonal lock nuts 112 threaded on to the left and right threaded portions 92 and 72 respectively, of the metering rod 70.

Figure 5A:
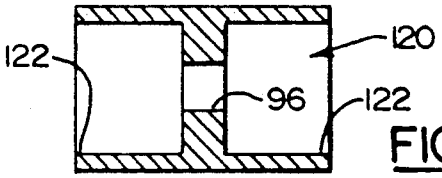
FIG. 5A is a sectional view of an alternate design of the metering piston.

An alternate configuration for the flow metering piston, bearing reference numeral 120, is shown in FIG. 5A. The flow metering port 96 is the same as that in the piston 94. The piston 120 is provided with skirt like extensions 122 on each axial end. The skirts 122 provide the seal with the inside surface of the chamber 44 instead of the 0-ring 100. The skirts 122 receive the springs 102 and 104 therein and serve to prevent bottoming of the springs under certain operating conditions.

As previously discussed in connection with FIG. 1, an assembled dual flow variable area expansion valve 12 is installed in the refrigerant line 40 extending between the indoor coil 22 and the outdoor coil 28 of a heat pump. As shown, the expansion device 12 is positioned in the outdoor heat exchanger assembly 18 close to the outdoor coil 28. The orientation of the device as installed is as shown in the other drawing figures and, as will be understood, a first variable area flow metering passage will serve as the cooling expansion orifice (with flow from right to left) and a second variable area flow metering passage will serve as the heating expansion orifice (with flow from left to right) during operation of the system.

For the description that follows the reversing valve 32 is positioned so that the system will operate in the cooling mode wherein the outdoor coil 28 functions as a condensing coil and the indoor coil 22 functions as an evaporator.

Referring back to FIG. 2, as indicated, the expansion valve is shown in a static no-flow condition. As shown, the springs 102 and 104 on opposite sides of the flow metering piston 94, cooperate to maintain the refrigerant metering piston 94 in the central portion 78 of the metering rod 70. As thus aligned the O-ring 82 carried by the rod and the O-ring 100 carried by the piston cooperate with their respective sealing surfaces to preclude flow of refrigerant through the expansion valve.

At the start of the cooling mode of operation, the pressure differential across the variable area dual flow expansion valve 12 will begin to develop, with the high side being to the right of the piston 94 and the low side to the left thereof. As the pressure differential across the piston develops, it urges the piston 94 to move to the left against the force of the spring 104.

When the piston 94 has moved out of sealing engagement with the central portion 78 of the rod the flow metering port 96 of the piston moves into coaxial relationship with the cooling configuration 88 of the rod 70.

Figure 3:
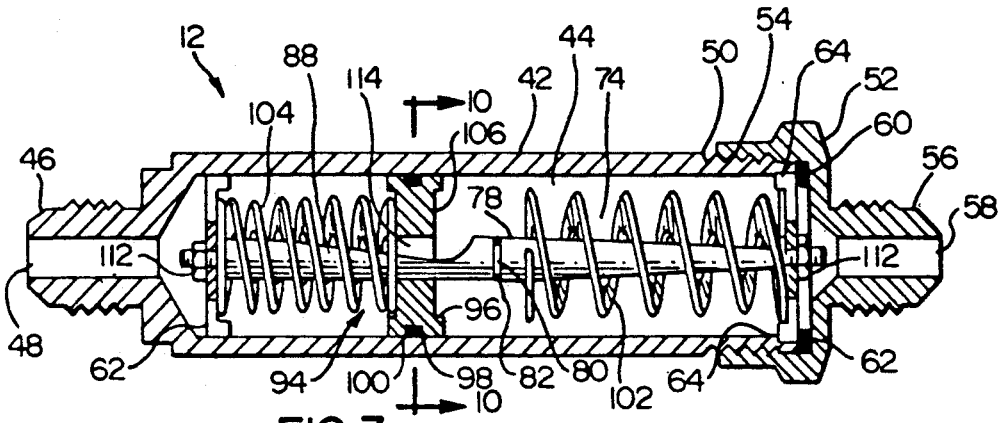
FIG. 3 is a longitudinal sectional view through the expansion device of FIG. 2 showing operation of the device while in the cooling mode of operation.
Figure 10:
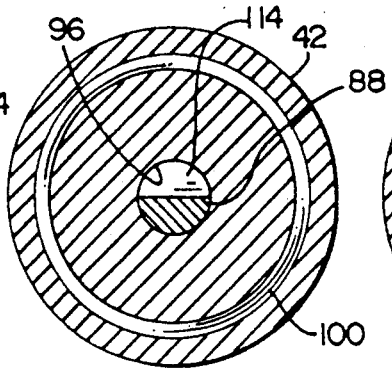
FIG. 10 is a sectional view of the expansion device taken along the lines 10—10 of FIG. 3.

As best shown in FIGS. 3 and 10 the flow metering port 96 and the cooling configuration 88 cooperate to define a space 114 therebetween. That space will hereinafter be referred to as the cooling variable area flow metering passage 114. FIG. 3 illustrates the expansion device as it appears in operation with a fairly low pressure differential across the piston. As a result, as will be explained, the cooling expansion passage 114 is relatively large.

As a general rule, in controlling the flow of refrigerant during the cooling mode of operation, it has been found that the cross sectional area of the cooling flow metering passage should be larger at low pressure differentials and decrease in size as the pressure differential across the piston 94 increases. It should accordingly be appreciated that the operation of the expansion valve 12 described above allows the device to control the cross sectional area of the cooling variable area flow metering passage 114 as a function of the pressure differential across the moveable metering piston 94.

By performing a pressure balance analysis on the piston, a designer is able to customize the geometry of the expansion device such that it is able to control the flow of refrigerant in a refrigeration system at optimum conditions over a wide range of conditions. The object of the design is to provide an optimum expansion area (i.e. the area 114 for cooling operation) for a variety of different indoor and outdoor temperature and humidity conditions. This is achieved by changing the cross-sectional area of the cooling configuration 88 of the flow metering rod 70 by machining an appropriate flow metering geometry thereon.

Figure 4:
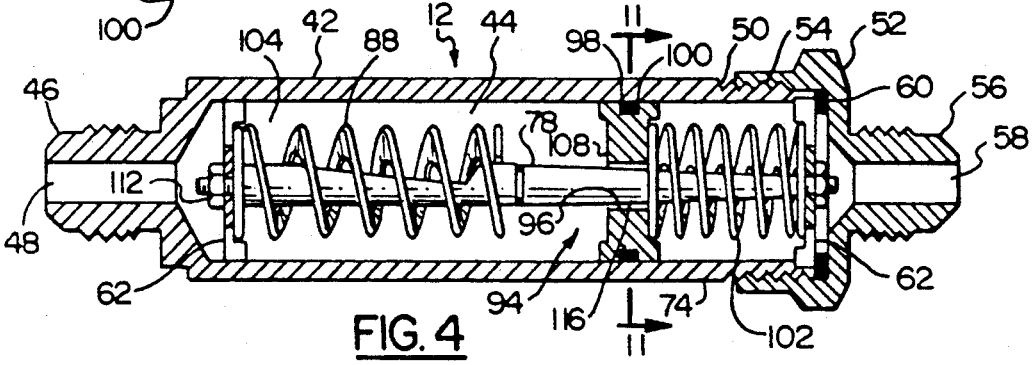
FIG. 4 is a longitudinal sectional view through the expansion device of FIG. 2 showing operation of the device while in the heating mode of operation.
Figure 9:
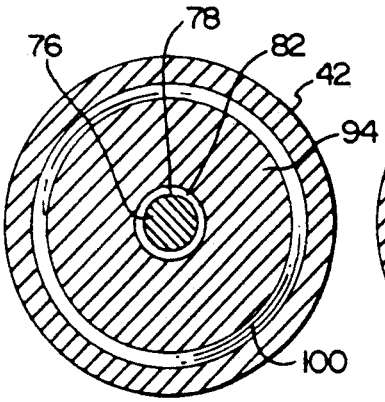
FIG. 9 is a sectional view of the expansion device taken along the line 9—9 of FIG. 2.
Figure 11:
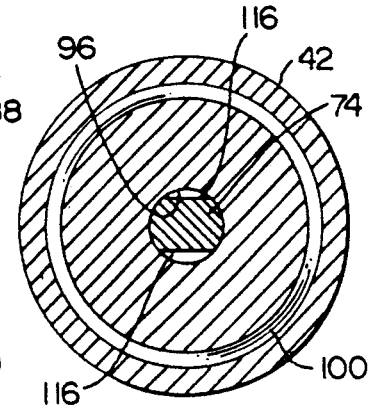
FIG. 11 is a sectional view of the expansion device taken along the line 11—11 of FIG. 4.

To operate the heat pump system 10 in the heating mode of operation, the setting of the reversing valve 32 is changed. As a result, hot gaseous refrigerant is discharged from the compressor 14 to the reversing valve 32 which directs the hot gaseous refrigerant to the indoor coil 22 which is now operating as a condenser and rejecting heat to the indoor space being heated. From the indoor condenser 22 the refrigerant is directed via refrigerant line 40 to the outdoor heat exchange assembly 18 where it passes through the dual flow variable area expansion device 12 and thence to the outdoor coil 28 which now serves as an evaporator. FIGS. 4 and 11 depict the dual flow variable area expansion valve 12 in the heating mode of operation with an intermediate pressure differential across the metering piston 94. In this position the metering port 96 of the piston cooperates with the heating configuration 74 of the refrigerant metering rod 70 to define a cooling variable area expansion passage 116 therebetween. With specific reference to FIG. 11, it will be noted that the heating variable area flow metering passage 116 is defined by several discreet segments on opposite sides of the rod. These segments are defined by separate tapers which form the heating configuration 74, on the rod 70.

As a general rule, in controlling the flow of refrigerant in the heating mode of operation it has been found that the cross sectional area of the heating metering configuration 74 should progress from a larger value adjacent the mid point of the rod 70 to a smaller value as the right hand end of the heating configuration 74 is approached. The relationship thus established is that the heating variable area flow metering passage 116 defined by the flow metering port 96 and the heating configuration 74 is small at low pressure differentials and increases as the pressure differential across the piston 94 increases. It should accordingly be appreciated that the operation of the dual flow variable area expansion device 12, as described above allows the device to control the cross sectional area of both a cooling variable area flow metering passage 114 and a heating variable area flow metering passage 116 as a function of the pressure differential across the piston 94.

When the expansion device 12 is in operation in a heat pump system, the position of the flow metering piston, with respect to the refrigerant metering rod may be determined by analyzing the forces acting on the opposite sides of the piston. The following equation sets forth these forces; $F=PA=Kx$. In the foregoing equation, the variables and constants are defined as follows: $P$=condensing pressure (high side pressure)—evaporating pressure (low side pressure); $A$=the area of the piston; $K$=the spring rate of the active spring, i.e. 102 for cooling and 104 for heating and $x$=piston travel with respect to the rod.

Using the above equation, along with well known refrigeration design techniques, a design engineer is able to design an expansion device 12 which is capable of controlling the flow of refrigerant in a heat pump system in both the heating and cooling modes of operation over a wide range of conditions.

It should be appreciated that a build up of a predetermined pressure is required prior to passage of fluid through the valve in either direction. As a result the valve prevents refrigerant migration in the systems during the off cycle.

A reduction in the amount of refrigerant charge required in a split system heat pump system may be realized by the use of a dual flow variable area expansion device such as that disclosed herein. Further significant cost advantages, due to the reduction in refrigerant charge required, may be realized by the elimination of an accumulator in the system.

A typical split system residential heat pump is designed with a substantially greater outdoor coil volume than indoor coil volume. This is done to maximize the cooling performance of the system, which is typically the major selling feature or purpose of a heat pump system. Because of the substantially larger outdoor coil volume, the circulated refrigerant charge is proportionately greater for cooling cycle operation than heating cycle operation. As a result of the necessity of using the higher charge quantity, heating operating modes are subject to flooding of the compressor which reduces the capacity and reliability of the system. Accumulators have necessarily been used in such systems to prevent the flow of liquid refrigerant through the suction line to the compressor.

The variable area expansion capability of the expansion valve of the present invention, in the cooling mode of operation, allows the device to adapt the expansion area to system operating conditions thereby optimizing values of sub-cooling and super heat. Tests conducted on a variable area expansion valve dedicated to cooling operation have shown that a reduction in refrigerant charge may be realized. It follows, that such a reduction in charge is obtainable with the device of the present invention.

Accordingly, it should be appreciated that a refrigerant expansion valve has been provided that meters the flow of refrigerant therethrough in one direction through a first orifice that varies in cross-sectional area as a function of the pressure differential across the valve. The same expansion valve controls refrigerant flow in the other direction therethrough through a second orifice that varies in cross sectional area as a function of the pressure differential across the valve.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

I claim:

1. A fluid flow metering device comprising:

a body having a flow passage extending therethrough;

a piston having a flow metering port extending therethrough, said piston being moveably disposed within said flow passage;

an elongated member extending through said flow metering port, said member having;

a sealing configuration thereon for cooperation with said flow metering port to prevent fluid flow through said port when said port and said sealing configuration are axially aligned with one another;

a first flow metering configuration thereon, on one side of said sealing configuration, adapted to cooperate with said flow metering port to define a first flow metering passage having a cross sectional area therebetween when they are axially aligned with one another, the cross sectional area of said first flow metering passage varying in relation to an axial position of said piston with respect to said first flow metering configuration; and a second flow metering configuration thereon, on the other side of said sealing configuration, adapted to cooperate with said flow metering port to define a second flow metering passage having a cross sectional area therebetween when they are axially aligned with one another, the cross sectional area of said second flow metering passage varying in relation to an axial position of said piston with respect to said second flow metering configuration;

means for axially and radially supporting said elongated member within said body;

means for supporting said piston with said flow metering port in axial alignment with said sealing configuration of said elongated member when no fluid is flowing through said device, and, for controlling the axial position of said piston with respect to said first flow metering configuration, as a function of the pressure differential across said piston, when fluid is flowing in a direction from said other side to said one side of said sealing configuration, and, for controlling the axial position of said piston with respect to said second flow metering configuration, as a function of the pressure differential across said piston, when fluid is flowing therethrough in the other direction.

2. The apparatus of claim 1 wherein;

said first flow metering configuration defines a minimum cross sectional area adjacent to said sealing configuration, and, increases in cross sectional area in a direction away from said sealing configuration;

and, said second flow metering configuration defines a maximum cross sectional area adjacent to said sealing configuration and decreases in cross sectional area in the direction away from said configuration.

3. The apparatus of claim 1 wherein said means for supporting and controlling said piston comprises;

means on said one side of said sealing configuration for biassing said piston towards said sealing configuration; and means on said other side of said sealing configuration for biassing said piston towards said sealing configuration.

4. The apparatus of claim 3 wherein both of said means for biasing are coil springs.

5. The apparatus of claim 1 wherein said means for supporting said elongated member comprises a first retainer rigidly attached to one end of said elongated member, and, means for rigidly attaching said retainer to said body.

6. The apparatus of claim 5 wherein said means for supporting includes a second retainer rigidly attached to the other end of said elongated rod.

7. The apparatus of claim 6 wherein said means for supporting and controlling said piston comprises a first coil spring surrounding said first flow metering configuration for biasing said piston towards said sealing configuration; and a second coil spring surrounding said second flow metering configuration for biasing said piston towards said sealing configuration.

8. The apparatus of claim 7 wherein one end of said first spring engages one end of said piston, and, the other end of said first spring engages of one said retainer; and wherein one end of said second coil spring engages the other end of said piston, and, the other end of second spring engages the other of said retainers.

9. The apparatus of claim 8 wherein;

said first flow metering configuration defines a minimum cross sectional area adjacent to said sealing configuration, and, increases in cross sectional area in the direction away from said sealing configuration;

and, said second flow metering configuration defines a maximum cross sectional area adjacent to said sealing configuration and decreases in cross sectional area in the direction away from said configuration.

* * * * *